United States Patent [19]

Grossmann

[11] 3,989,587

[45] Nov. 2, 1976

[54] SYSTEM FOR INSTALLING ENDLESS BELTS IN A MACHINE FOR MAKING MULTIPLE-PLY PAPER PRODUCTS

[75] Inventor: Udo Grossmann, Heidenheim (Brenz), Germany

[73] Assignee: J. M. Voith GmbH, Heidenheim, Germany

[22] Filed: Sept. 15, 1975

[21] Appl. No.: 613,306

Related U.S. Application Data

[63] Continuation of Ser. No. 442,139, Feb. 13, 1974, abandoned.

[30] Foreign Application Priority Data

Feb. 17, 1973 Germany ..... 2307848

[52] U.S. Cl. ..... 162/200; 162/273; 162/274; 162/304

[51] Int. Cl.[2] ..... D21F 9/02

[58] Field of Search ..... 162/200, 133, 273, 274, 162/299, 300, 303, 304

[56] References Cited

UNITED STATES PATENTS

| | | | |
|---|---|---|---|
| 2,799,209 | 7/1957 | Wisner et al. | 162/273 |
| 2,950,224 | 8/1960 | Balough | 162/273 X |
| 3,025,909 | 3/1962 | Hart | 162/273 |
| 3,900,364 | 8/1975 | Nelson et al. | 162/274 |

FOREIGN PATENTS OR APPLICATIONS

| | | | |
|---|---|---|---|
| 714,307 | 7/1965 | Canada | 162/304 |
| 1,561,671 | 5/1972 | Germany | 162/300 |

*Primary Examiner*—S. Leon Bashore
*Assistant Examiner*—Richard V. Fisher
*Attorney, Agent, or Firm*—Michael J. Striker

[57] ABSTRACT

An elongated machine frame has a plurality of uprights which are spaced longitudinally of the frame and subdivide the same into individual sections each provided with a support structure. A first plurality of rollers is cantilevered on the support structures in these sections and an endless felt web is trained about and supported by these first rollers, extending over substantially the length of the machine frame. Each section has an endless upper screen located above the felt web and defining with the same a gap in which a ply formed upon the respective upper screen is laid onto the felt web. The upper screens are each supported by a plurality of second rollers which are also cantilevered on the respective support structures. Cutouts are provided in the support structure to permit installation and removal of the felt web and the upper screen.

3 Claims, 3 Drawing Figures

SYSTEM FOR INSTALLING ENDLESS BELTS IN A MACHINE FOR MAKING MULTIPLE-PLY PAPER PRODUCTS

This is a continuation of application Ser. No. 442,139, filed Feb. 13, 1974, now abandoned.

BACKGROUND OF THE INVENTION

The present invention relates generally to a machine for making multiple-ply paper products, such as cardboard and the like.

Machines for making multiple-ply paper products, such as cardboard or the like, are already known. Generally speaking, they have heretofore used a screen or forming wire on which one layer or ply of the paper product was directly formed. Since this had to cooperate with other wires for other plys, and considering the relatively large number of plys which is often required in making cardboard, the carrier screen or forming wire often had to be very long. Such very long forming wires, however, are extremely expensive and highly susceptible to damage. Moreover, when a new forming wire of such great length is to be installed in the machine, a very substantial amount of time is required for its installation, meaning of course that the utilization of such screens is highly labor-intensive. Moreover, they are evidently capital-intensive since a relative large outlay of capital is required to obtain such screens.

For these reasons the prior art has already proposed to provide two forming wires, one behind the other, each of which is associated with several upper screens or forming wires. However, in these constructions, also, the main forming wires can be replaced only if all of the components located within the loop formed by the endless forming wire can be shifted out of the loop by appropriately mounting them, which is evidently highly expensive, or if other difficult, cumbersome and space-consuming expedients are utilized.

Since this also was not satisfactory in terms of the desired ease of replacing the main forming wire, another approach suggested by the prior art has been to insert the strip-shaped forming wire into the machine, train it about the various rollers and other components with which it cooperates, and then weld its ends together to form an endless belt. This approach facilitates the installation of the forming wire, but has the disadvantage that the welded seam which must be produced frequently is not durable enough to last for the required period of time. Moreover, it is not usually possible to so construct the seam that it will not leave marks on the cardboard or other paper product being produced, which is clearly not permissible.

SUMMARY OF THE INVENTION

Accordingly, it is a general object of the invention to overcome the disadvantages of the prior art.

More particularly, it is an object of the present invention to provide an improved machine for making multiple-ply paper products, such as cardboard and the like, wherein the aforementioned disadvantages are avoided.

An additional object of the invention is to provide such an improved machine wherein a rapid and simple replacement of an endless forming web is assured.

In keeping with these objects, and with others which will become apparent hereafter, one feature of the invention resides, in a machine for making multiple-ply paper products, such as cardboard and the like, in a combination which comprises an elongated machine frame provided with a plurality of longitudinally spaced uprights which subdivide the frame into individual sections. A support structure is provided at each of these sections, and a first plurality of rollers is cantilevered on the support structures in the sections. An endless felt web is trained about and supported by the roller means of the first plurality, and the felt web extends over substantially the length of the machine frame and constitutes the equivalent of the hitherto used forming wire. A plurality of endless upper screens is provided, each being located in one of the sections above the felt web and in part defining with the same a gap in which a ply formed upon the respective upper screen is laid onto the felt web. A second plurality of roller means is also cantilevered on the support structures in their respective sections, and the roller means of the second plurality support and guide the respective upper screens. A plurality of stock inlets is provided, one for each of the upper screens, and each of these stock inlets is mounted on one of the uprights and supplies paper stock to the respectively associated upper screen.

With such a construction the endless felt web can be slipped in bunched-up or package form over one of its associated rollers, and then can be pulled apart in longitudinal direction of the machine frame to be slipped onto the other rollers associated with it. This makes the insertion of the new felt web very simple, assuring that replacement can take place any time when required and with a minimum of difficulty. Moreover, it is possible to install or remove the web with such great ease despite the fact that it is of the endless and seamless type, and it is not necessary to provide expensive special structures which occupy considerable space and were heretofore required if an endless forming wire was to be capable of being replaced with anything approaching reasonable ease.

The novel features which are considered as characteristic for the invention are set forth in particular in the appended claims. The invention itself, however, both as to its construction and its method of operation, together with additional objects and advantages thereof, will be best understood from the following description of specific embodiments when read to connection with the accompanying drawings.

DESCRIPTION OF THE PREFERRED EMBODIMENTS

Figure 1:
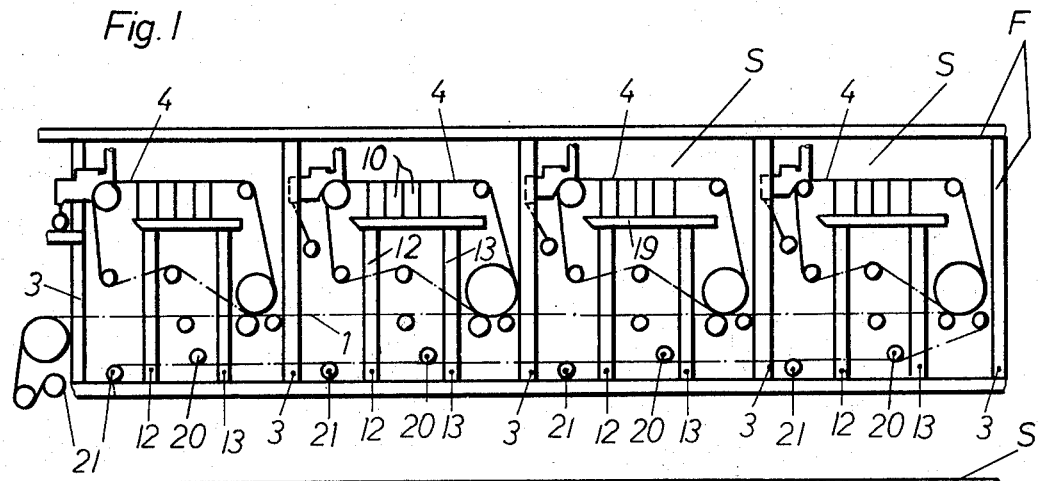
FIG. 1 is a diagrammatic side view of a multiple-ply cardboard making machine.
Figure 2:
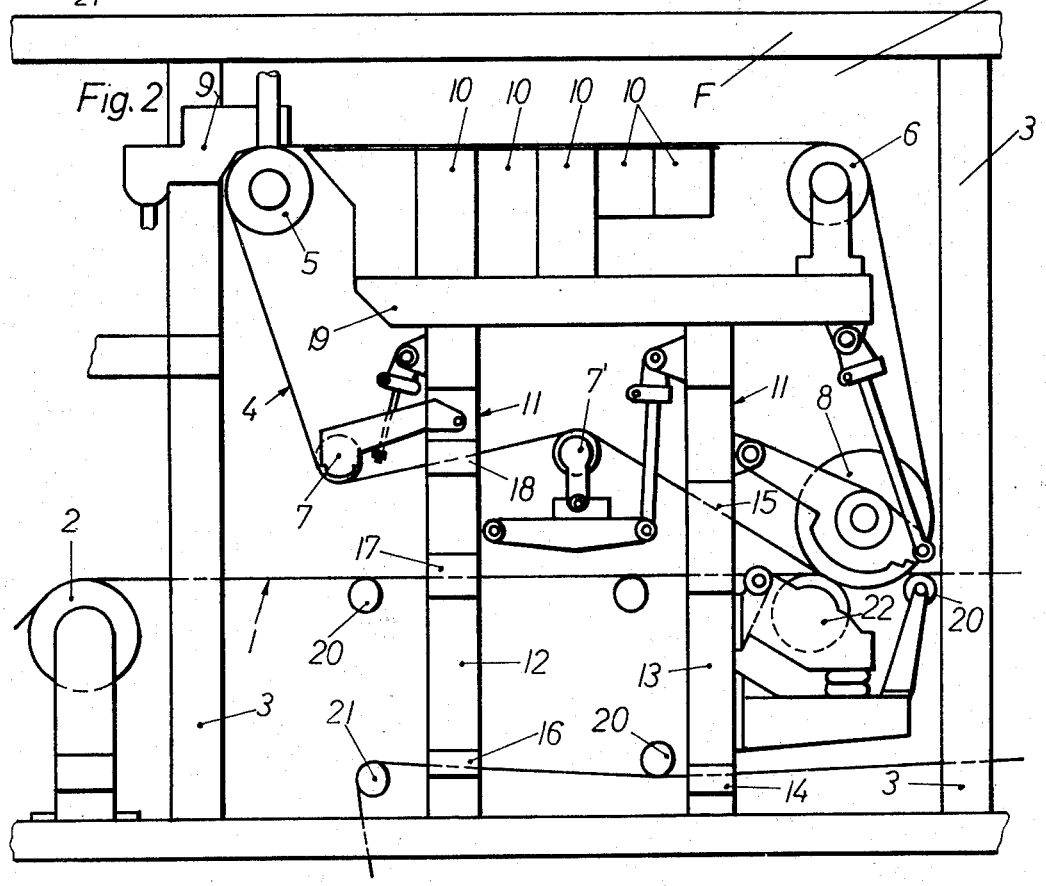
FIG. 2 illustrates one section of the machine of FIG. 1, on an enlarged scale.
Figure 3:
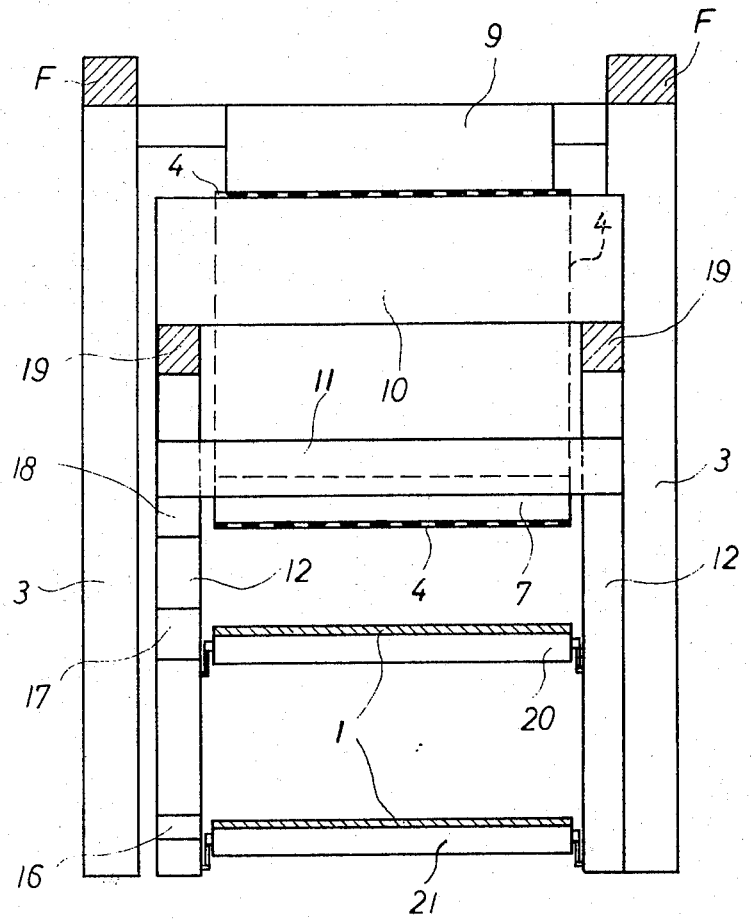
FIG. 3 is a vertical section through FIG. 2, taken midway of FIG. 2 and looking towards the left.

Referring now to FIGS. 1–3, which show a single illustrative embodiment of the invention, it will be seen that FIG. 1 shows diagrammatically a multiple-ply cardboard making machine, whereas FIGS. 2 and 3 show details of the machine. The machine has an elongated frame F which can be constructed in any known manner and which is subdivided by a plurality of uprights 3, spaced longitudinally of the frame F, into a plurality of sections S. In each of these sections, a ply is produced and laid onto an endless felt web 1 which extends over substantially the entire length of the frame F.

As FIG. 2 shows most clearly, the felt web 1 is trained about a suction roller 2, and FIG. 3 shows clearly that it is located between two transversely spaced rows of the uprights 3, with two of these uprights 3 which are transversely spaced always being located between two successive ones of the upper forming wires 4 which are located in the respective sections S.

Each ply of paper product required for making the cardboard on the web 1 is formed on one of the upper screens 4 which are also endless and may be in conventional manner of metal or the like. These upper screens or forming wires 4 each travel about a breast roller 5, a deflecting roller 6 and two tensioning rollers 7, 7'. A pressure roller 8 guides a portion of each of the upper screens 4 against the felt web 1 to define with the same a nip in which the ply formed on the respective upper screen 4 is laid onto the felt web 1. The respective breast roller 5 has associated with it a stock inlet 9 mounted advantageously on an upright 3 and discharging in known manner a fibrous suspension onto the travelling upper screen 4 which is associated with it. The suspension becomes deposited on the upper surface of the screen 4 which travels in clockwise direction in the illustrated embodiment, so that after the suspension becomes deposited on the upper surface of the screen 4 it travels on this upper surface over a plurality of suction boxes 10 which are located beneath the upper run of the respective upper screen 4 intermediate the breast roller 9 and the deflecting roller 6. The suction boxes 10 serve to withdraw water from the suspension, leaving only a ply of paper product deposited on the surface of the travelling upper screen 4.

In accordance with the invention, the rollers 5, 6, 7, 7' and 8 as well as the suction boxes 10 are all mounted in cantilever manner on a support structure which is provided in the respective section S. Each support structure has two cross beams 11 which are formed at the drive side, that is the side of the frame F where the drive for the various rollers is located, with a thrust-resisting support member and a tie rod (both of them not illustrated). On the control side of the frame F, that is the other side from the drive side, each support structure is provided with two upright support members 12 and 13 which extend to and are secured on the base member of the frame F and which are provided with removable, i.e., detachable portions 14, 15 and 16, 17, 18 (see FIG. 2) the removal of which creates cut-outs in the support members. Further, each support structure has two carriers 19 extending longitudinally of the machine frame F and on which the rollers 5, 6 and the suction boxes 10 are also mounted.

The guide rollers 20, 21 and a further press roller 22, all of which are associated with the endless felt web 1, are also mounted in cantilever manner on the upright support members 12, 13 and the thrust-resisting support members at the drive side.

When, in a machine according to the present invention, an endless felt web 1 is to be replaced with a new one, for instance because it has been worn or for some other reason, the damaged felt web is removed in any desired manner, for instance by cutting it apart. When the new felt web 1 is to be installed, the latter is pushed in bunched-up or packaged form over the suction roller 2 in axial direction of the latter, for which purpose one of the supports of the suction roller can be removed. The web 1 is then pulled into the machine in such a way that it lies underneath the rolls 20 which are inside the area surrounded by the web 1 in the installed condition of the same. Then the portions 14 and 16 of the upright support members 12 and 13, are removed. At this time, the cross members 11 constitute the sole support of the respective support structure. The upper run of the web 1 can now be withdrawn laterally from the machine between a pair of uprights 3. Now, the portions 14 and 16 are replaced and the portions 15 and 17 are removed, enabling the upper run of the web 1 to be introduced into the machine in its correct position. Since the portion 15 is located between the locations where the rollers 8 and 22 are secured, the insertion of the upper run of the web 1 causes the upper run also to be introduced into the nip formed between the two pressure rollers 8 and 22.

When a new upper screen 4 is to be inserted in lateral direction, the portion 15 of the upright support member 13 is removed, and similarly a separate portion 18 which is removably provided on the upright support member 12. The provision of this separate portion 18 is necessary because the tensioning roller 7' is mounted on the upright support member 12 intermediate the felt web 1 and the upper screen 4.

It will be appreciated that is of course necessary that between each of the uprights 3 and the respectively closest component about which the web 1 passes, i.e. a guide roller, a sufficient gap must be left through which the web 1 can be introduced, and of course this gap can be relatively narrow, as shown in FIG. 3.

It will be possible to eliminate the removable portions in the upright support members 12 and 13 and to find a different solution, but it is currently preferred to provide these portions because with this construction it is possible to mount both of the press rollers 8 and 22 which are required to deposit a ply from the respective upper screen 4 upon the web 1, on one and the same support element.

It will be understood that each of the elements described above, or two or more together, may also find a useful application in other types of constructions differing from the types described above.

While the invention has been illustrated and described as embodied in a machine for making multiple-ply paper products, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A machine for making multiple-ply paper products, comprising an elongated machine frame having two lateral sides; support means on said frame and including first upright support members at one of said sides and second upright support members at the other of said sides; a plurality of first rollers rotatably cantilevered on said first support members, extending transversely of said frame towards but short of said second support members and having free ends adjacent the same; and endless felt web element trained about said first rollers and having an upper run and a lower run which travel in a first path and have portions which extend across said second upright support members; a plurality of second rollers also rotatably cantilevered on said first support members, extending transversely of said frame towards but short of said second support members and also having free ends adjacent the same; at least one endless screen element trained about said second rollers for travel in a second path; means defining upper and lower cut-outs in said second upright support members extending all the way therethrough in transverse direction and located opposite said portions of said upper and lower runs of said web element; and detachable portions normally closing said upper and lower cut-outs and being removable therefrom so as to open said cut-outs to permit installation and removal of said web element by slipping said upper and lower runs of the same through said upper and lower cut-outs, respectively, onto and off said free ends of said first rollers.

2. A machine for making multiple-ply paper products, comprising an elongated machine frame having two lateral sides; support means on said frame and including first upright support members at one of said sides and second upright support members at the other of said sides; a plurality of first rollers rotatably cantilevered on said first support members, extending transversely of said frame towards but short of said second support members and having free ends adjacent the same; an endless felt web element trained about said first rollers for travel in a first path of which portions extend across said second upright support members; a plurality of second rollers also rotatably cantilevered on said first support members, extending transversely of said frame towards but short of said second support members and also having free ends adjacent the same; at least one endless screen element trained about said second rollers for travel in a second path of which portions also extend across said second upright support members; means defining cut-outs in said second upright support members extending all the way therethrough in traverse direction and located opposite said portions of said web element and said screen element, respectively; and detachable portions normally closing said cut-outs and being removable therefrom so as to open said cut-outs to permit installation and removal of said elements by slipping the same through said cut-outs onto and off said free ends of said first or second rollers, respectively, said detachable portions of each second upright support member including a lower detachable portion for a cut-out through which a lower run of said web element may be moved, and an upper detachable portion for another cut-out through which an upper run of said web element and a lower run of said screen element can be moved.

3. A method of installing an endless belt-shaped element in a paper-making machine, comprising the steps of opening normally closed upper and lower cut-outs formed in a set of upright support members which are located at one side of the machine, the cut-outs extending all the way through these support members and being located opposite the free axial ends of rollers which are cantilevered from a set of additional upright support members located at the opposite side of the machine; slipping the lower run of an endless belt-shaped web element through the opened lower cut-outs and the upper run of the same web element through the opened upper cut-outs, and via said free axial ends onto said rollers; and re-closing said upper and lower cut-outs to prevent escape of said upper and lower runs of said web element therethrough.

* * * * *